US007156394B1

(12) United States Patent
Boyle

(10) Patent No.: US 7,156,394 B1
(45) Date of Patent: Jan. 2, 2007

(54) METHOD AND DEVICE FOR PLAYING MODIFIED GAMES OF CHESS

(76) Inventor: David Boyle, 2004 W Maple St., Lansing, MI (US) 48915

( * ) Notice: Subject to any disclaimer, the term of this patent is extended or adjusted under 35 U.S.C. 154(b) by 0 days.

(21) Appl. No.: 11/023,853

(22) Filed: Dec. 28, 2004

(51) Int. Cl.
*A63F 3/00* (2006.01)

(52) U.S. Cl. ..... 273/260; 273/255; 273/262

(58) Field of Classification Search ..... 273/260, 273/255, 261, 262
See application file for complete search history.

(56) References Cited

U.S. PATENT DOCUMENTS

| | | | | |
|---|---|---|---|---|
| 3,794,326 | A | 2/1974 | Bialek | |
| 3,881,731 | A * | 5/1975 | Droney | 273/291 |
| 3,908,999 | A * | 9/1975 | Brown | 273/260 |
| 4,762,323 | A * | 8/1988 | Blagg | 273/126 R |
| 5,011,159 | A | 4/1991 | Fortunato et al. | |
| 5,636,841 | A * | 6/1997 | Burroughs | 273/260 |
| 5,749,583 | A | 5/1998 | Sadounichvili et al. | |
| 6,062,562 | A | 5/2000 | Pardee | |
| 6,142,474 | A | 11/2000 | Tachkov et al. | |
| 6,719,289 | B1 | 4/2004 | Brown et al. | |

FOREIGN PATENT DOCUMENTS

| | | |
|---|---|---|
| GB | 1072945 | 6/1967 |

* cited by examiner

*Primary Examiner*—Vishu K. Mendiratta
(74) *Attorney, Agent, or Firm*—Michael R. Kutas

(57) ABSTRACT

A method for playing a modified game of chess includes the steps of providing a game board having a plurality of rows and columns to define a grid-like pattern and providing each player a set of game cubes, each of which defines six faces. Five of said faces include depictions, the other is blank. Each depiction is assigned a range of movement. In turn, each player must place a game cube on any unoccupied space, blank face disposed opposite the game board. Once all game cubes are so placed, each player is allowed, in turn, to rotate one game cube, move a game cube according to the depiction of the face disposed opposite the game board to capture game cubes of opponents, or return any captured game cube to the game board. Points are awarded for capturing opponent's game cubes until a player achieves a predetermined number of points.

4 Claims, 3 Drawing Sheets

METHOD AND DEVICE FOR PLAYING MODIFIED GAMES OF CHESS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to a chess game, more specifically to a method for playing a modified game of chess for a plurality of players and utilizing game cubes.

2. Description of the Related Art

The present invention finds its origins in the traditional game of chess. For centuries chess, a game played on a board comprised of alternating colored squares to form a grid-like pattern, wherein two players match their skills against each other, has been the standard-bearer for games of strategic thinking. The traditional game of chess follows standard rules for chessboard set-up, movement of the various game pieces, and manner for winning the match.

There have been numerous variations of the traditional game of chess. Chess players and inventors have introduced means of adding additional players and means of introducing chance into the traditional game. For example, U.S. Pat. No. 3,794,326 (Bialek) describes a variation of the traditional game of chess designed for two players, utilizing the traditional rules of game-board set-up and traditional game pieces, wherein the players alternate turns rolling a pair of dice embossed with the depictions of standard chess pieces. The player must then move one of their pieces depicted on the face disposed opposite the game board of one of the two dice.

U.S. Pat. No. 6,142,474 (Tachkov, et al.) describes a game suitable for two to four players with each player being designated a set of game pieces modified from the traditional game of chess, and assigned a quadrant of the game board. Players can form alliances with other players, with play proceeding along the same general rules of the traditional game.

U.S. Pat. No. 6,719,289 (Brown et al.) describes a variation of the traditional game of chess wherein two players are assigned a conventional set of game pieces and are dealt 7 or 11 cards from a deck of 50 cards which dictate movement on the game board.

Finally, U.S. Pat. No. 5,749,583 (Sadounichvili et al.) describes a further variation of the traditional game of chess, wherein the traditional elements of chess are combined with a set of new game pieces with individually assigned movements, along with a "reducer having four lateral sides in surrounding relationship with a rectangular aperture formed between the lateral sides."

Among the deficiencies in the prior art that are addressed in the present invention, the single most significant is that inventions in the prior art limit the skill necessary to play the respective variations to that of the traditional game of chess, or below.

Thus, there is a need in the related art for a variation of the traditional game of chess that provides a new variation of the traditional game of chess allowing for inclusion of a plurality of players, is easy to learn, increases the skill level necessary to play the game, provides variation in set-up and game play with each new game, is portable, and is inexpensive to manufacture.

BRIEF SUMMARY OF THE INVENTION

The present invention overcomes the disadvantages in the related art in a method for playing a modified game of chess among a plurality of players. The method includes the steps of providing a game board having a plurality of rows and columns to define a substantially grid-like pattern of alternating colored spaces. Each player is provided with a set of a plurality of game cubes adapted to be disposed on, and freely manually movable along, the game board from one space to another space, and each of which defines six faces. Five of the faces include respective depictions, and the sixth is blank. Each depiction is assigned a different possible range of movement relative to the other depictions for the respective game cube along the game board from one space to another space. In turn, each player is allowed to place a respective game cube on any unoccupied space such that the blank face is disposed opposite the game board. Once all of said game cubes are placed upon the game board, each player is then allowed, in turn, to rotate a game cube such that a different face is disposed opposite the game board, move the game cube along the game board from one space to another space according to the depiction of the face disposed opposite the game board to capture any of the game cubes of respective opponents, or return any captured game cube of the player to the game board in any unoccupied space with the blank face disposed opposite the game board. Points are awarded to respective players for capturing any game cubes of opponents until a player achieves a predetermined total number of points.

An advantage of the method for playing modified game of chess of the present invention is a method to provide for a new variation of the game of chess for a plurality of players.

Another advantage of the method for playing modified game of chess of the present invention is a method to provide for a new variation of the game of chess, which is played on a flexible game board.

Another advantage of the method for playing modified game of chess of the present invention is a method to provide for a new variation of the game of chess, which is easily portable.

A further advantage of the method for playing modified game of chess of the present invention is a method to provide for a new variation of the game of chess, which is easy to learn.

Yet another advantage of the method for playing modified game of chess of the present invention is a method to provide for a new variation of the game of chess with several variation of the preferred embodiment to add new challenges to the standard version.

Still another advantage of the method for playing modified game of chess of the present invention is a method to provide for a new variation of the game of chess, which is easy and inexpensive to manufacture.

A still further advantage of the method for playing modified game of chess of the present invention is a method to provide for a new variation of the game of chess where the rules of play remain the same regardless of the number of players.

Other objects, features, and advantages of the present invention will become apparent from the following descriptions, taken in connection with the accompanying drawings, wherein, by way of illustration and example, an embodiment of the present invention is disclosed.

DETAILED DESCRIPTION OF THE INVENTION

Figure 1:
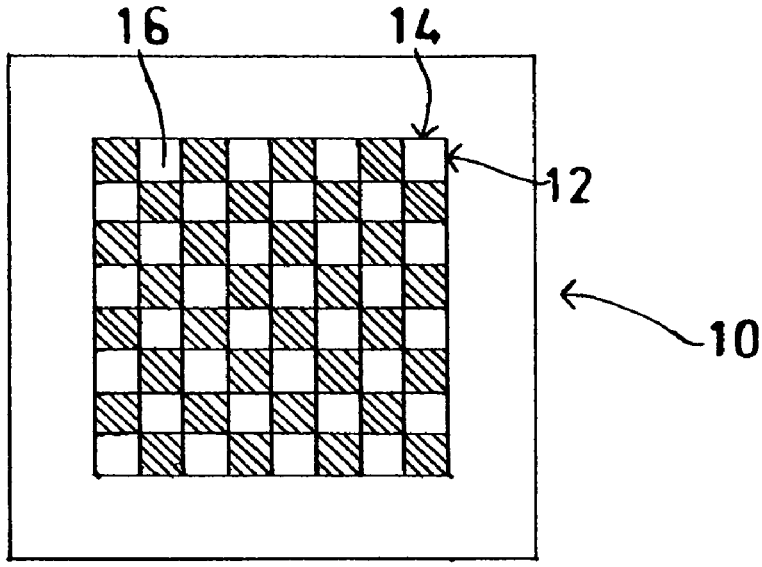
FIG. 1 is a plan view of the game board, detailing 8 rows and 8 columns of alternating colored spaces.

Referring to the drawings contained herein, there is shown in FIG. 1, a game board, generally indicated at 10, comprised of 8 rows, generally indicated at 12, and 8 columns, generally indicated at 14. These rows 12 and columns 14 form a substantially grid-like surface of alternating colored squares 16. In the preferred embodiment the game board 10 is made of a flexible material such as canvas. However, it will be appreciated by those having ordinary skill in the art that the game board 10 can include any suitable number of rows 12 and columns 14. It will also be appreciated that the game board 10 can be made of other suitable materials.

Figure 2:
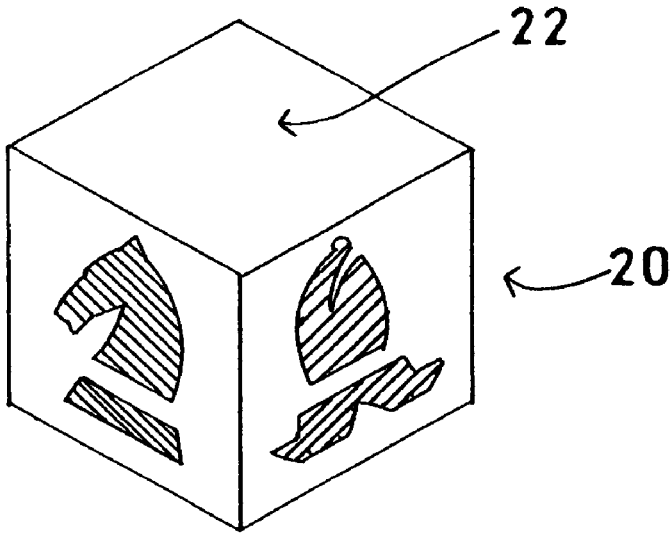
FIG. 2 is a perspective view of a game cube, illustrating the depictions of traditional chess pieces on the faces of the game cubes, with the top face being blank.

FIG. 2 depicts the principal game piece, the game cube, generally indicated at 20, comprised of 6 substantially symmetrical and substantially square faces, generally indicated at 22. In the preferred embodiment, the game cube 20 is made of wood. However, it will be appreciated by those having ordinary skill in the art that the game cube 20 can be made from any suitable material.

There are plurality of game cubes 20 divided into "sets." In the preferred embodiment there are 6 sets of game cubes 20 with each set consisting of 6 such game cubes 20. Each set of game cubes 20 is assigned a distinguishing color. However, it will be appreciated by those having ordinary skill in the art that there may be any suitable number the game cubes 20 per set. It will also be appreciated that there may be any suitable number of sets of game cubes 20.

In the preferred embodiment, each face 22 of each game cube 20 is imprinted, in that set's distinguishing color, with depictions of traditional chess pieces, as depicted in FIGS. 3*a*–3*f*.

Figure 3:
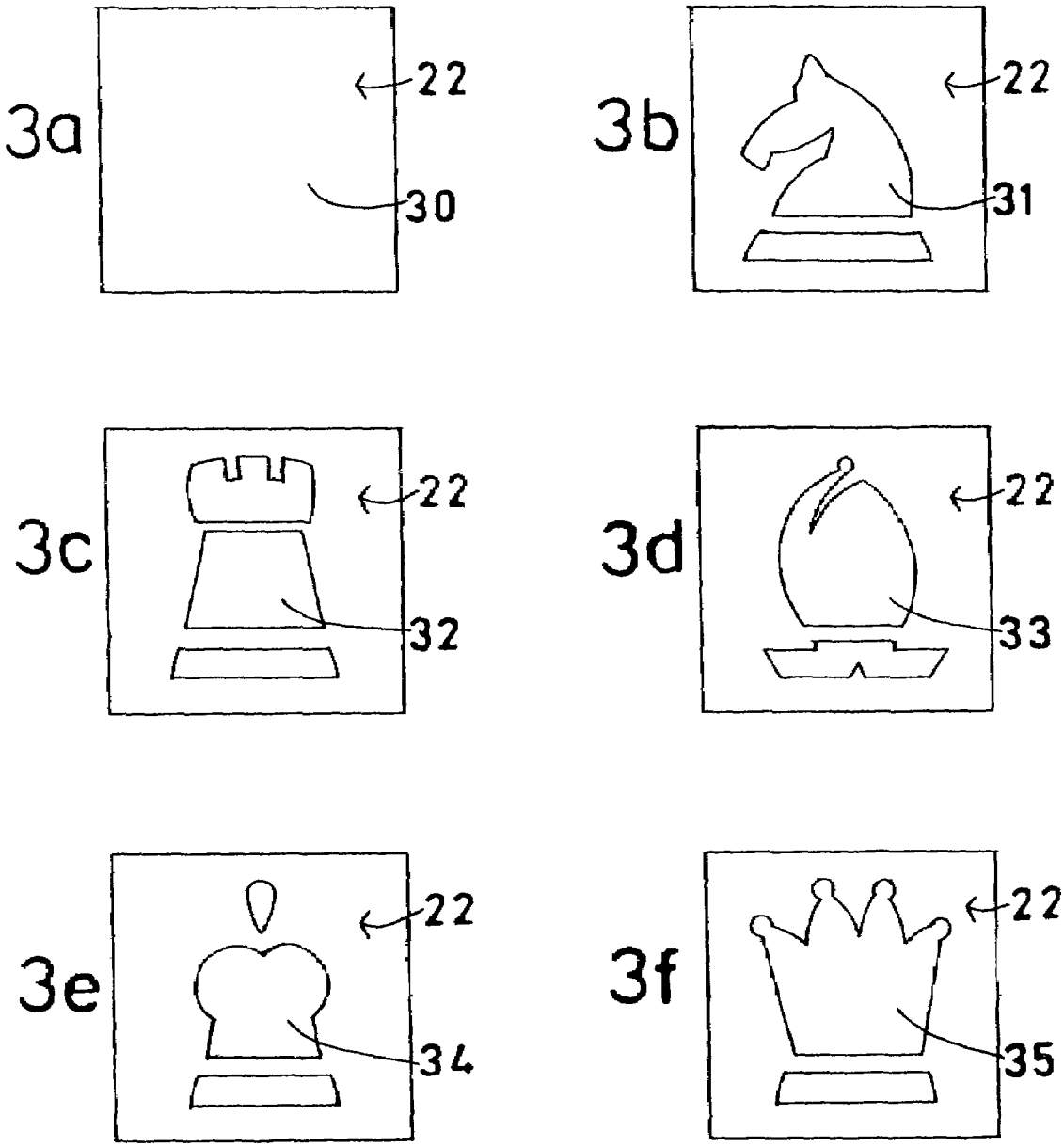
FIG. 3*a* is a plan view of a face of the game cube depicting the blank face.
FIG. 3*b* is a plan view of a face of the game cube depicting the Knight.
FIG. 3*c* is a plan view of a face of the game cube depicting the Rook.
FIG. 3*d* is a plan view of a face of the game cube depicting the Bishop.
FIG. 3*e* is a plan view of a face of the game cube depicting the King.
FIG. 3*f* is a plan view of a face of the game cube depicting the Queen.

In the preferred embodiment, each game cube 20 contains one face 22 imprinted with a depiction of a Knight 31, as depicted in FIG. 3*b*, one face 22 imprinted with a depiction of a Rook 32, as depicted in FIG. 3*c*, one face 22 imprinted with a depiction of a Bishop 33, as depicted in FIG. 3*d*, one face 22 imprinted with a depiction of a King 34, as depicted in FIG. 3*e*, and one face 22 imprinted with a depiction of a Queen 35, as depicted in FIG. 3*f*. The final face 22 of each game cube 20 is left blank 30, as depicted in FIG. 3*a*. The depiction on the opposite face of the game cube 20 from the blank face 30 is always the Queen 35. However, it will be appreciated by those having ordinary skill in the art that the various faces 22 of the game cube 20 can be imprinted with any suitable depiction, whether from the traditional game of chess, or otherwise.

The present invention is designed for a plurality of players, in the preferred embodiment the number of players is 2 to 6 players. Play begins with the game board 10 devoid of game cubes 20 and each player choosing a colored set of game cubes 20. The players randomly chose one player to begin play. The player randomly chosen to begin play places one of his or her game cubes 20 on the game board 10, with the blank face 30 of the game cube 20 disposed opposite the game board 10. Play then continues in a clockwise manner around the game board 10, with each player in turn placing a game cube 20 onto the game board 10 in any unoccupied square, with blank face 30 of each said game cube 20 disposed opposite the game board 10. This process continues until all players have placed all of their game cubes 20 on the game board 10.

Once all players have placed all of their game cubes 20 onto the game board 10, the player randomly selected to start play then is permitted to make one of several moves. The first option that a player has on their turn is to rotate one of their game cubes 20 to position a different face 22 disposed opposite the game board 10. The player may only rotate one game cube 20 per turn, and may only rotate the game cube 20 one face 22. As such, a player with a game cube 20 having the blank face 30 disposed opposite the game board 10 cannot rotate the game cube 20 in one move to position the depiction of the Queen 35 disposed opposite the game board 10.

A second option on a player's turn is to move one of his or her own game cubes 20, based upon the depiction disposed opposite the game board 10, at the start of that player's move. Movement of said game cubes 20 are derived from the traditional game of chess.

Figure 4:
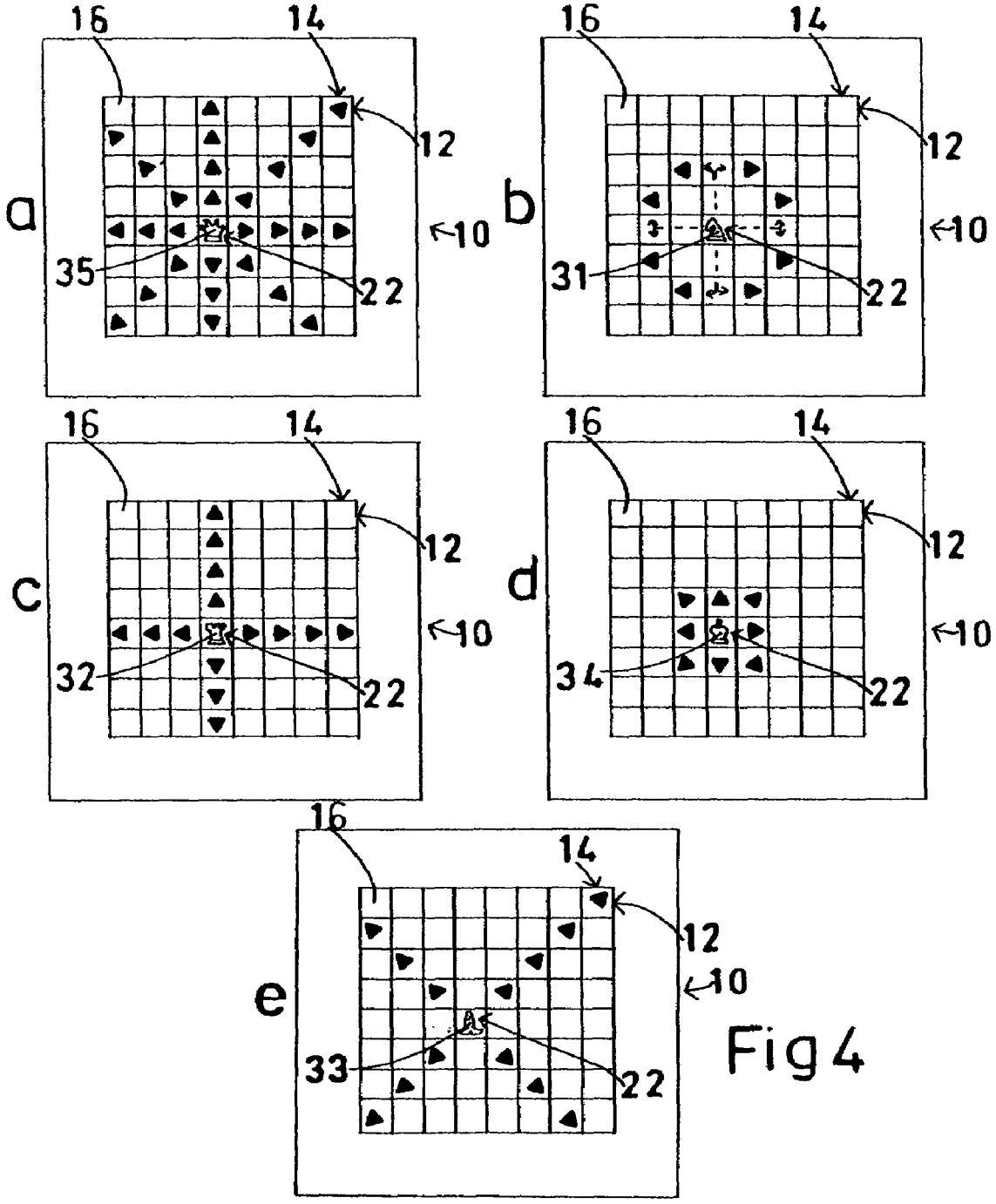
FIG. 4*a* is a plan view of the game board depicting the moves of the game cubes when the face disposed opposite the game board is the Queen.
FIG. 4*b* is a plan view of the game board depicting the moves of the game cubes when the face disposed opposite the game board is the Knight.
FIG. 4*c* is a plan view of the game board depicting the moves of the game cubes when the face disposed opposite the game board is the Rook.
FIG. 4*d* is a plan view of the game board depicting the moves of the game cubes when the face disposed opposite the game board is the King.
FIG. 4*e* is a plan view of the game board depicting the moves of the game cubes when the face disposed opposite the game board is the Bishop.

FIG. 4*a* depicts the movement of the game cube 20 when the depiction of the Queen 35 is disposed opposite the game board 10. The Queen 35 can move on the game board 10 to any space 16 in a straight line horizontally, vertically, or diagonally from the space on which it stands. The Queen 35 cannot, however, move over any intervening game cube 20.

FIG. 4*b* depicts the movement of the game cube 20 when the depiction of the Knight 31 is disposed opposite the game board 10. The Knight 31 moves in an L-shaped pattern, being 2 spaces 16 in either the horizontal or vertical direction, and 1 space 16 in the opposite direction, being vertical or horizontal, from the space 16 in which it stands. When moving, the Knight 31 does move over any intervening game cubes 20, interacting only with a game cube 20 in its destination space 16.

FIG. 4*c* depicts the movement of the game cube 20 when the depiction of the Rook 32 is disposed opposite the game board 10. The Rook 32 moves to any space 16 in a straight line either horizontally or vertically from the space 16 in which it stands. When moving, the Rook 32 cannot move over any intervening game cubes 20.

FIG. 4*d* depicts the movement of the game cube 20 when the depiction of the King 34 is disposed opposite the game board 10. The King 34 moves to any space 16 on the game board 10 adjacent to the space 16 in which it stands.

FIG. 4*e* depicts the movement of the game cube 20 when the depiction of the Bishop 33 is disposed opposite the game board 10. The Bishop 33 moves to any space 16 in a straight line diagonally from the space 16 in which it stands. When moving, the Bishop 33 cannot move over any intervening game cubes 20.

A game cube 20 with the blank face 30 disposed opposite the game board 10 cannot be moved, except as to rotate the game cube 20 as described above.

However, it will be appreciated by those having ordinary skill in the art that the movement of the game cubes 20 can be set in any suitable manner. It will be further appreciated by those having ordinary skill in the art that the number of players can be set in any suitable manner.

By moving one of his or her own game cubes 20 into a space 16 on the game board 10 occupied by an opponent's game cube 20, that player "captures" the opponent's game cube 20. The captured game cube 20 is removed from the game board 10, and points are awarded to the player so capturing an opponent's game cube 20. Points awarded vary depending upon the depiction disposed opposite the game board 10 at the time of capture. If a player captures an opponent's game cube 20 with the blank face 30 disposed opposite the game board 10, the player so capturing the game cube 20 is awarded one point.

If the captured game cube 20 had the depiction of either the Knight 31 or the King 34 disposed opposite the game board 10, two points are awarded to the player so capturing that game cube 20.

If the captured game cube 20 had the depiction of either the Rook 32 or the Bishop 33 disposed opposite the game board 10 at the time of capture, three points are awarded to the player so capturing that game cube 20.

If the captured game cube 20 had the depiction of the Queen 35 disposed opposite the game board 10 at the time of capture, five points are awarded to the player so capturing that game cube 20.

However, it will be appreciated by those having ordinary skill in the art that the awarding of points for capturing an opponent's game cube 20 can be set in any suitable manner.

The final move that a player has the option to make on his or her turn is to return one of his or her own captured game cubes 20 to the game board 10 in any unoccupied space 16, blank face 30 disposed opposite the game board 10.

Play continues around the game board 10, in a clockwise direction, with each player in turn selecting one of the three options per turn, until one player achieves a pre-determined number of points, in the preferred embodiment being 20 points. However, it will be appreciated by those having ordinary skill in the art that the total number of points necessary to win the game may be set at any number.

Additionally, one skilled in the relevant art will appreciate that rules of play can be altered from the herein described preferred embodiment to vary play. One such variation allows the players to begin rotating or moving their game cubes 20 as soon as at least one of their game cubes 20 have been placed upon the game board 10.

A further variation allows players to make two of the above described options on each turn. Another variation requires that each player exchange one of his or her own game cubes 20 with one of each opponent. Rules of play continue as in the preferred embodiment with players placing game cubes 20 onto the game board 10 in turn until all game cubes 20 have been placed, blank face 30 disposed opposite the game board 10, onto the game board 10. However, in this variation the player places one of each of his or her opponent's and the remaining game cubes 20 in his or her set of game cubes 20.

As can easily be seen, the method for playing a modified game of chess of the present invention provides a new variation of the game of chess that maintains the same set of instructions when any number of a plurality of players are playing, is portable, inexpensive to manufacture, is easy to learn, and provides for a different game set up and strategy with each game.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Method for playing a modified game of chess among a plurality of players, said method comprising the steps of:

providing a game board having a plurality of rows and columns to define a substantially grid-like pattern of alternating colored spaces;

providing each player with a set of a plurality of game cubes adapted to be disposed on, and freely manually moveable along, said game board from one of said spaces, to another of said spaces and each of which defines six faces wherein five of said six faces include respective depictions with one said depiction being a king, one said depiction being a queen, one said depiction being a rook, one said depiction being a bishop, one said depiction being a knight and the sixth said face being blank, each of said depictions being assigned its common chess range of movement along said game board from one of said spaces to another of said spaces, with said blank side being feely able to rotate within said space of said game board which it occupies but unable to advance to another space along said game board while said blank side is disposed opposite said game board;

allowing each player, in turn, to place a respective game cube on any unoccupied one of said spaces of said game board such that said blank face is disposed opposite said game board until all of said game cubes are placed on the game board;

then allowing each player, in turn, to perform any one of the steps including rotating said respective game cube such that a different face is disposed opposite said game board, moving said game cube along said game board from one of said spaces to another of said spaces according to said depiction of said face disposed opposite said game board to capture any of said game cubes of respective opponents, and returning any captured one of said plurality of game cubes of the player to said game board; and awarding points to respective players for capturing any of said plurality of game cubes of opponents, until a player achieves a predetermined total number of points.

2. A method for playing a modified game of chess as set forth in claim 1, allowing each player, in turn, to perform any two of said steps.

3. A method for playing a modified game of chess as set forth in claim 1, allowing each player, in turn, to perform any one of said steps prior to all game cubes being placed upon the game board.

4. A method for playing a modified game of chess as set forth in claim 1, providing each player with a set of a plurality of game cubes wherein is included one game cube from each of his or her respective opponents.

* * * * *